US011565305B2

(12) United States Patent
Chang

(10) Patent No.: US 11,565,305 B2
(45) Date of Patent: Jan. 31, 2023

(54) WIRE STRAIGHTENING TOOL

(71) Applicant: Yi-Chin Chang, New Taipei (TW)

(72) Inventor: Yi-Chin Chang, New Taipei (TW)

( * ) Notice: Subject to any disclaimer, the term of this patent is extended or adjusted under 35 U.S.C. 154(b) by 82 days.

(21) Appl. No.: 17/338,740

(22) Filed: Jun. 4, 2021

(65) Prior Publication Data

US 2022/0388054 A1 Dec. 8, 2022

(51) Int. Cl.
*B21F 1/02* (2006.01)

(52) U.S. Cl.
CPC ..... *B21F 1/02* (2013.01)

(58) Field of Classification Search
CPC .. B21F 1/002; B21F 1/02; B21F 1/023; B25B 7/02; B25B 7/08; H02G 1/1292; E04H 17/268
USPC ..... 140/117–120
See application file for complete search history.

(56) References Cited

U.S. PATENT DOCUMENTS

2006/0179636 A1* 8/2006 Valenzuela ..... B21F 1/002 29/505
2018/0093849 A1* 4/2018 Estermann ..... D07B 3/04

* cited by examiner

*Primary Examiner* — Debra M Sullivan

(57) ABSTRACT

A wire straightening tool contains: a press portion, an urging portion, and a rotation portion. The press portion includes a fixing orifice, the urging portion is an urging element mounted on a bottom of the press portion away from the receiving orifice and configured to urge the press portion to return back to an original position after pressing the press portion. The rotation portion is accommodated in the receiving orifice of the press portion, and the rotation portion includes a rotatable knob and a wire removal element. The rotatable knob has a coupling orifice passing through the rotatable knob, and the wire removal element is received in the coupling orifice. The wire removal element has multiple through orifices defined thereon.

7 Claims, 9 Drawing Sheets

WIRE STRAIGHTENING TOOL

FIELD OF THE INVENTION

The present invention relates to a hand tool, and more particularly to a wire straightening tool which is capable of straightening a twisted wire to straighten an insulation layer of the twisted wire easily and quickly.

BACKGROUND OF THE INVENTION

A wire (such as a telephone wire or a network wire) is applied to send signals, wherein the wire is twisted and is covered by an insulation layer. However, when connecting the wire to a socket or other electric components (such as a controller, a motor, a sensor, and a switch), a part of the insulation layer on the wire has to be straightened so as to connect with a socket or other electric components electrically.

Nevertheless, it is difficult to straighten the insulation layer from the wire. Moreover, the wire is broken when straightening the insulation layer therefrom.

The present invention has arisen to mitigate and/or obviate the afore-described disadvantages.

SUMMARY OF THE INVENTION

One aspect of the present invention is to provide a wire straightening tool which is capable of straightening a twisted wire to straighten an insulation layer of the twisted wire easily and quickly.

To obtain the above aspects, a wire straightening tool provided by the present invention contains: a press portion, an urging portion, and a rotation portion.

The press portion includes a fixing orifice defined on an end thereof and passing through the press portion.

The urging portion is an urging element mounted on a bottom of the press portion away from the receiving orifice and configured to urge the press portion to return back to an original position after pressing the press portion.

The rotation portion is accommodated in the receiving orifice of the press portion, and the rotation portion includes a rotatable knob and a wire removal element. The rotatable knob has a coupling orifice passing through the rotatable knob, the wire removal element is received in the coupling orifice, and the wire removal element has multiple through orifices defined thereon.

Preferably, the press portion includes a first pressing element and a second pressing element, the first pressing element has multiple first passing orifices, the second pressing element has multiple second passing orifices, and a fixing element passes through the multiple first passing orifices and the multiple second passing orifices to connect the first pressing element with the second pressing element, thus forming a grip section.

Preferably, the resilient element is a spring.

Preferably, the urging portion is a spring.

Preferably, the urging portion is one-piece formed with the press portion.

Preferably, the rotation portion is accommodated in the receiving orifice of the press portion.

Preferably, the rotatable knob of the rotation portion has multiple protrusions, and the coupling orifice of the rotatable knob has a slope.

Preferably, the wire removal element of the rotation portion has a locating section defined on a predetermined position thereof, a diameter of the locating section is less than a diameter of the wire removal element, and the wire removal element is glued so as to connect the rotatable knob with the wire removal element.

Preferably, the wire removal element has a releasing segment formed on a first end thereof, and the wire removal element has a supplying segment formed on a second end thereof, a depth of the releasing segment is more than a depth of the supplying segment, and a width of the releasing segment is less than a width of the supplying segment.

In operation, the grip section of the press portion is grasped manually, and a front end of a twisted wire which is not twisted is accommodated in the wire removal element of the rotation portion so that the other part of the front end of the twisted wire is put into the multiple through orifices from the releasing segment of the wire removal element. Since the depth of the releasing segment is more than the depth of the supplying segment, and the width of the releasing segment is less than the width of the supplying segment, the twisted wire does not straighten, and the multiple protrusions of the rotatable knob of the rotation portion are rotated by a user's finger(s) so that the rotatable knob rotates and actuates the wire removal element to revolve, and the twisted wire is pushed manually or the wire straightening tool is moved so that the twisted wire extends out of the supplying segment from the releasing segment via the multiple through orifices, and the wire removal element revolves to untwist the twisted wire.

DETAILED DESCRIPTION OF THE PREFERRED EMBODIMENTS

Figure 1:
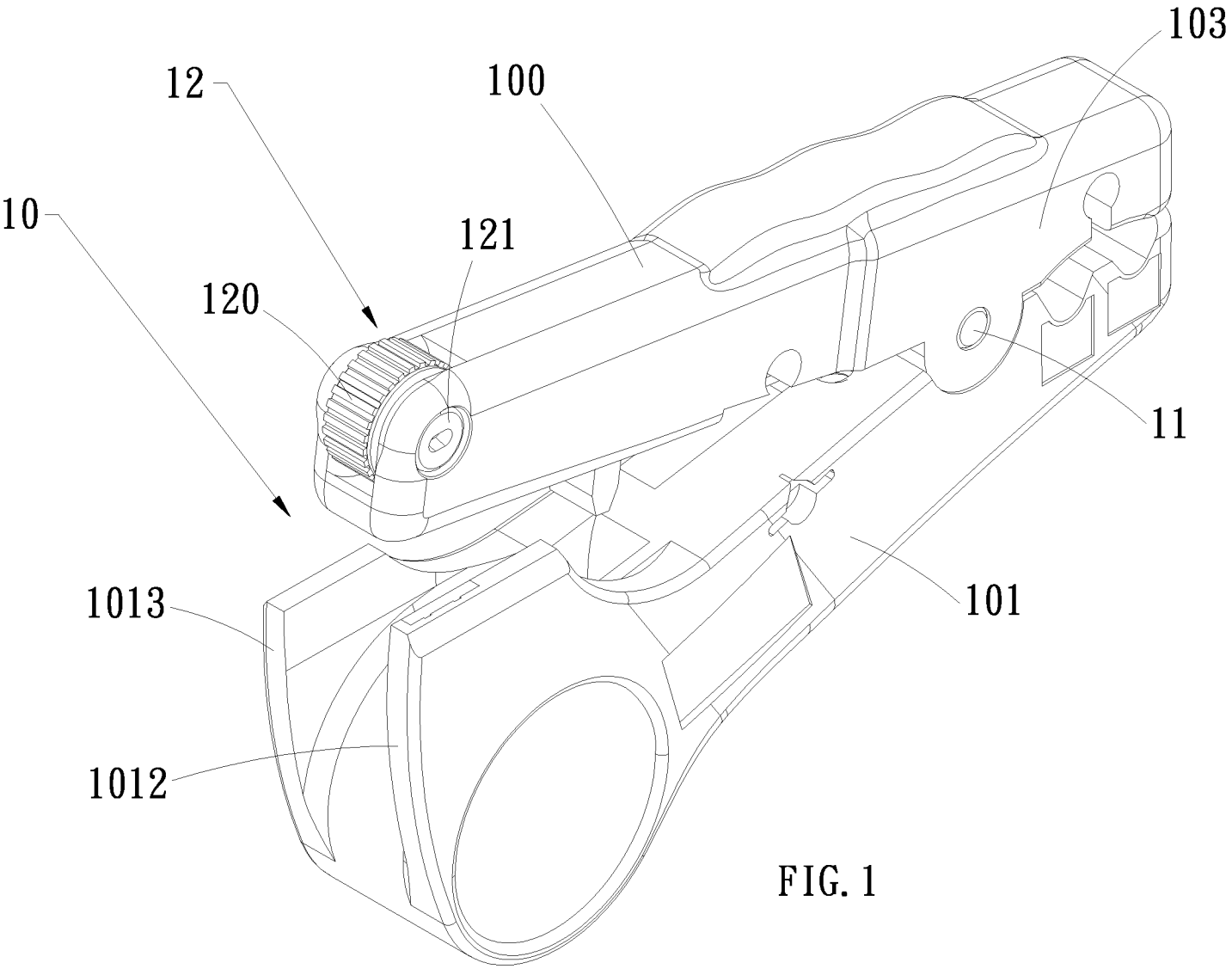
FIG. 1 is a perspective view showing the assembly of a wire straightening tool according to a first embodiment of the present invention.
Figure 2:
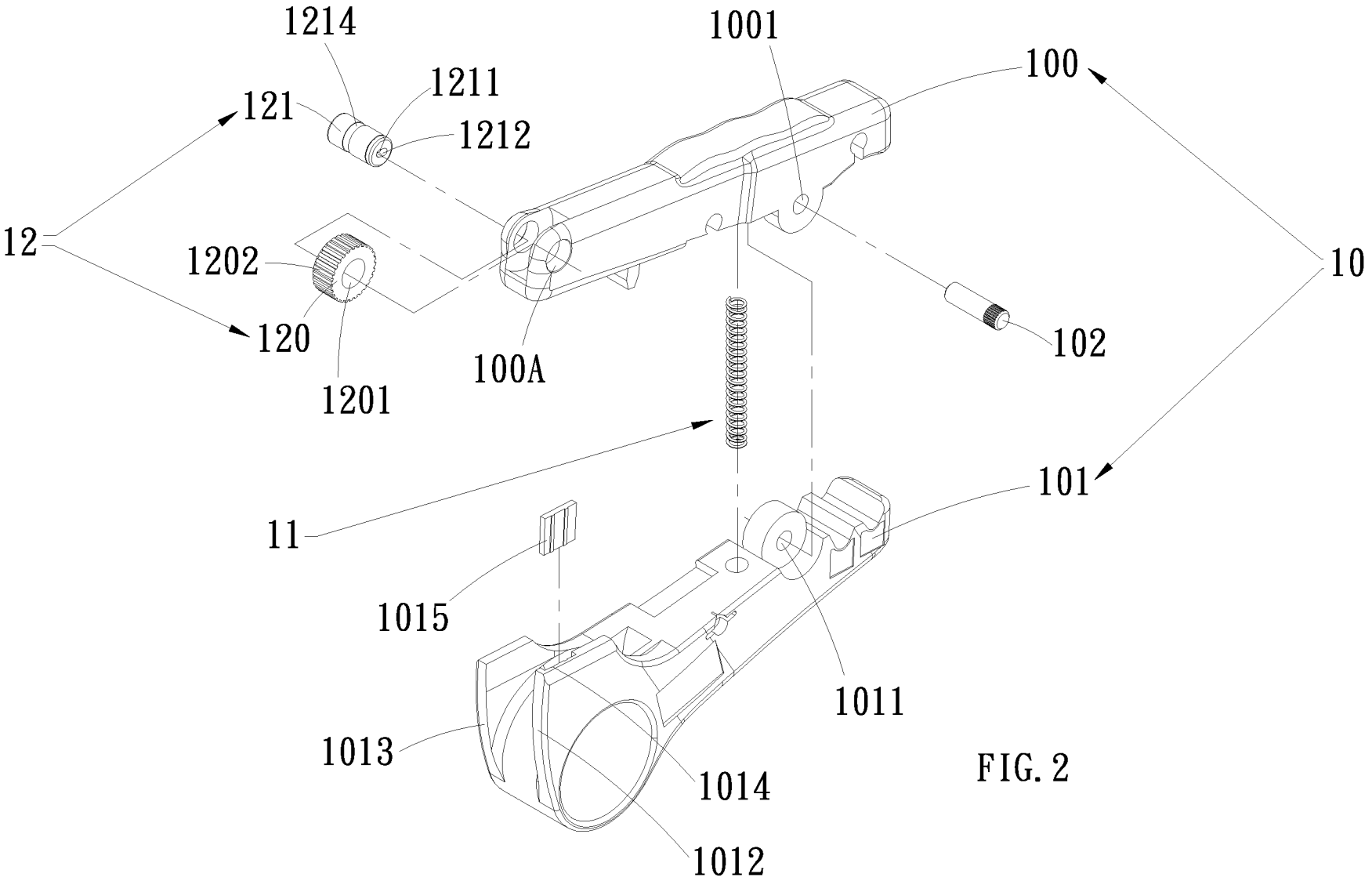
FIG. 2 is a perspective view showing the exploded components of the wire straightening tool according to the first embodiment of the present invention.
Figure 3:
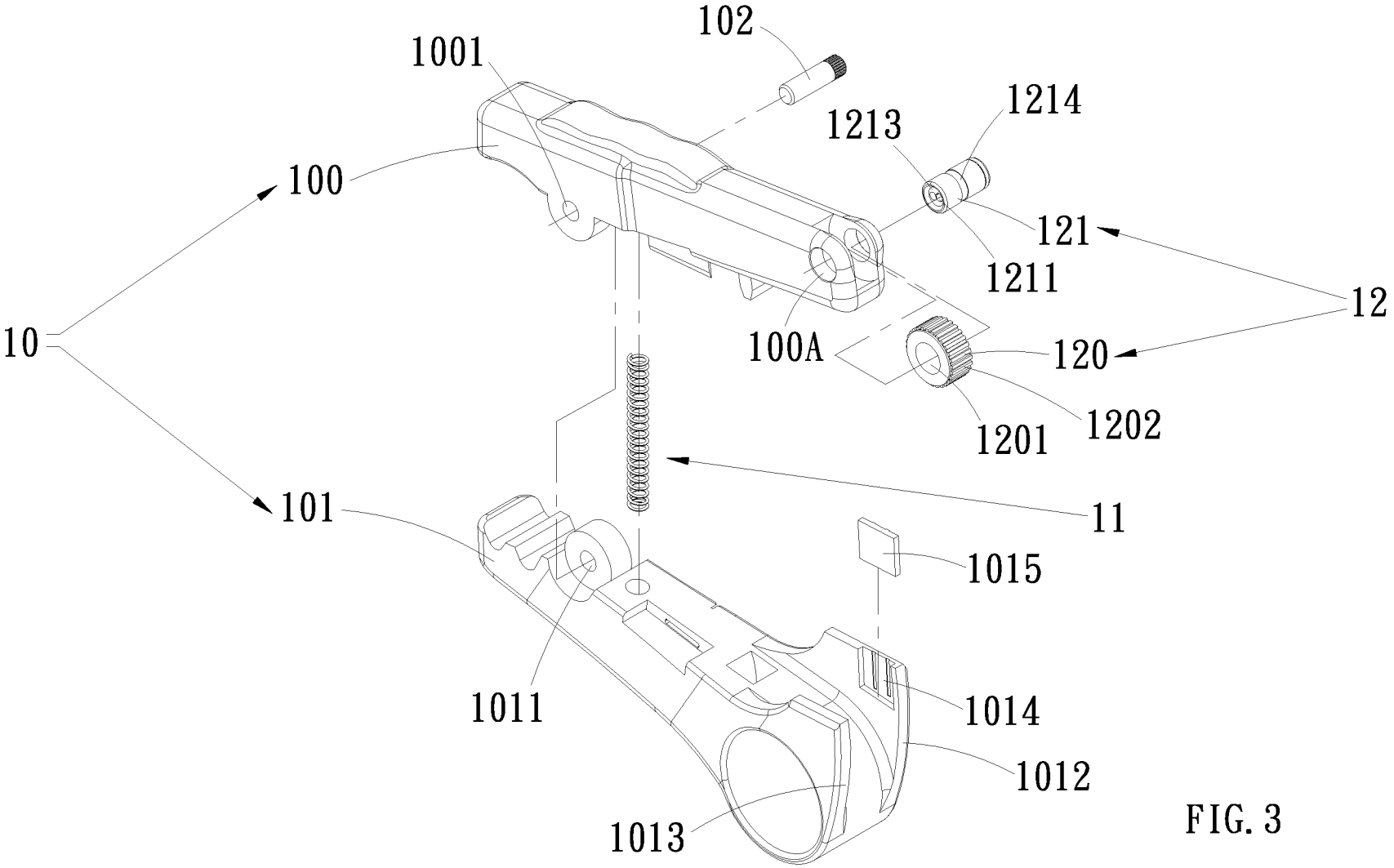
FIG. 3 is a perspective view showing the exploded components of the wire straightening tool according to a second embodiment of the present invention.
Figure 4:
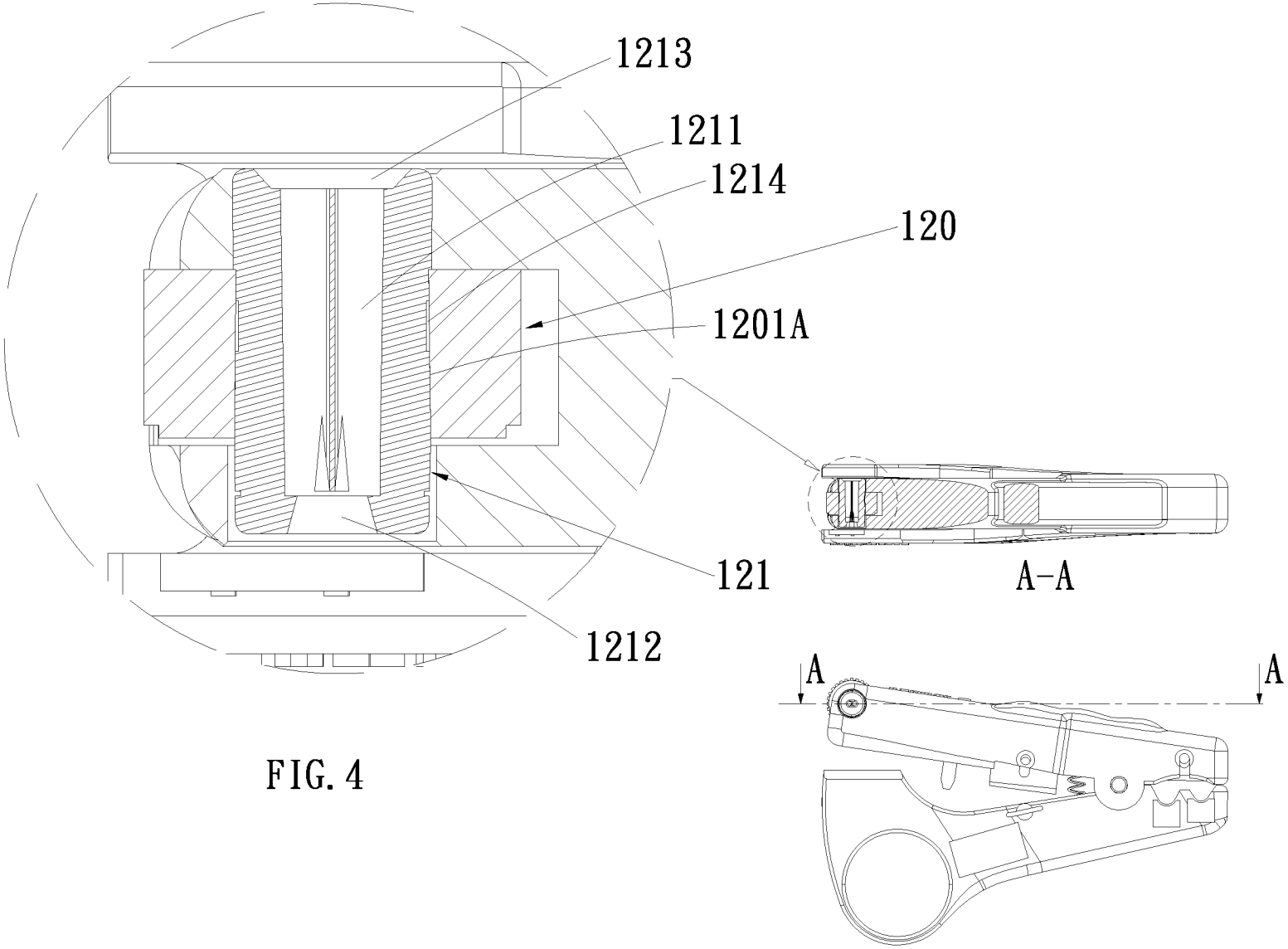
FIG. 4 is a cross sectional view showing the assembly of a part of the wire straightening tool according to the first embodiment of the present invention.
Figure 5:
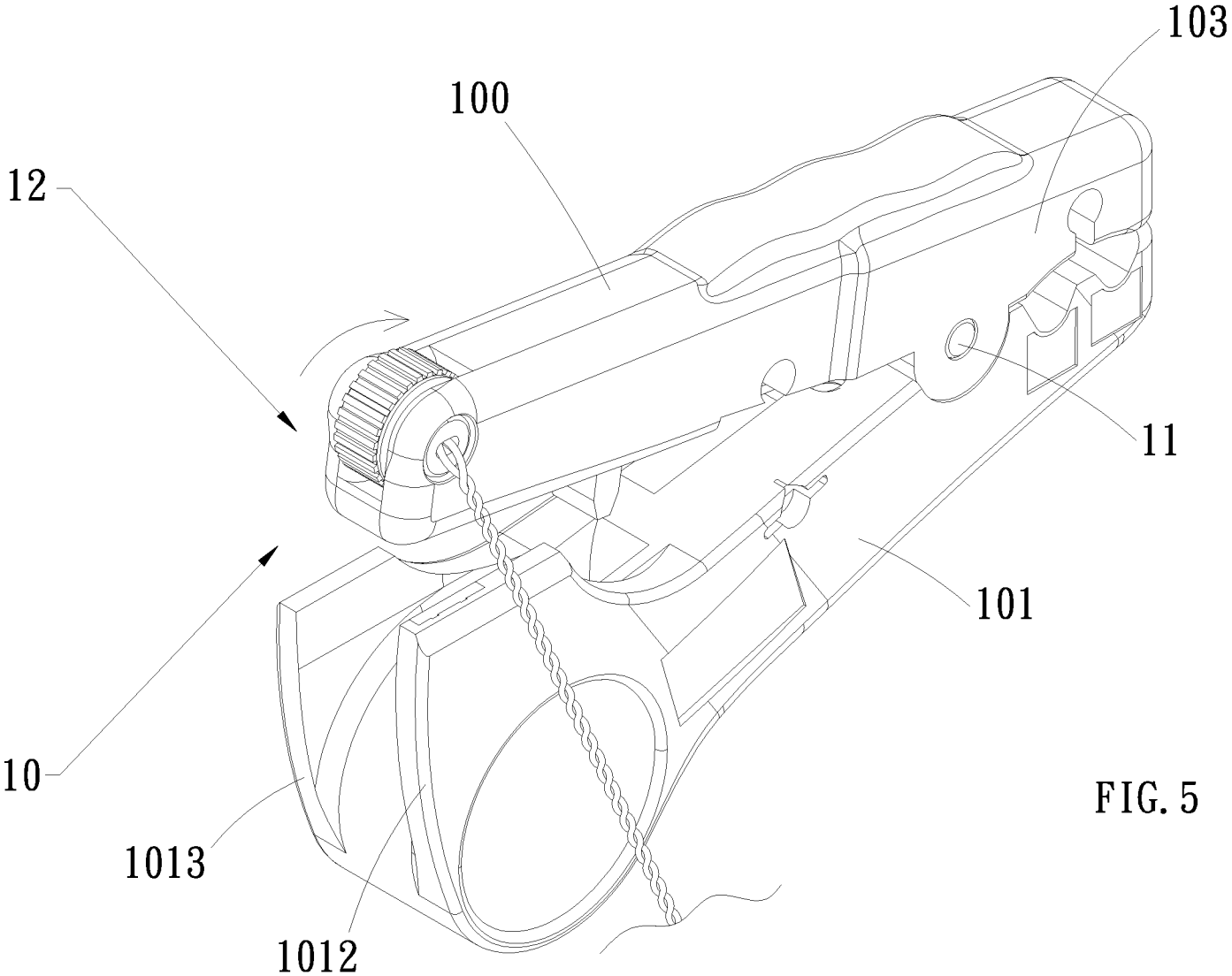
FIG. 5 is a perspective view showing the operation of the wire straightening tool according to the first embodiment of the present invention.
Figure 6:
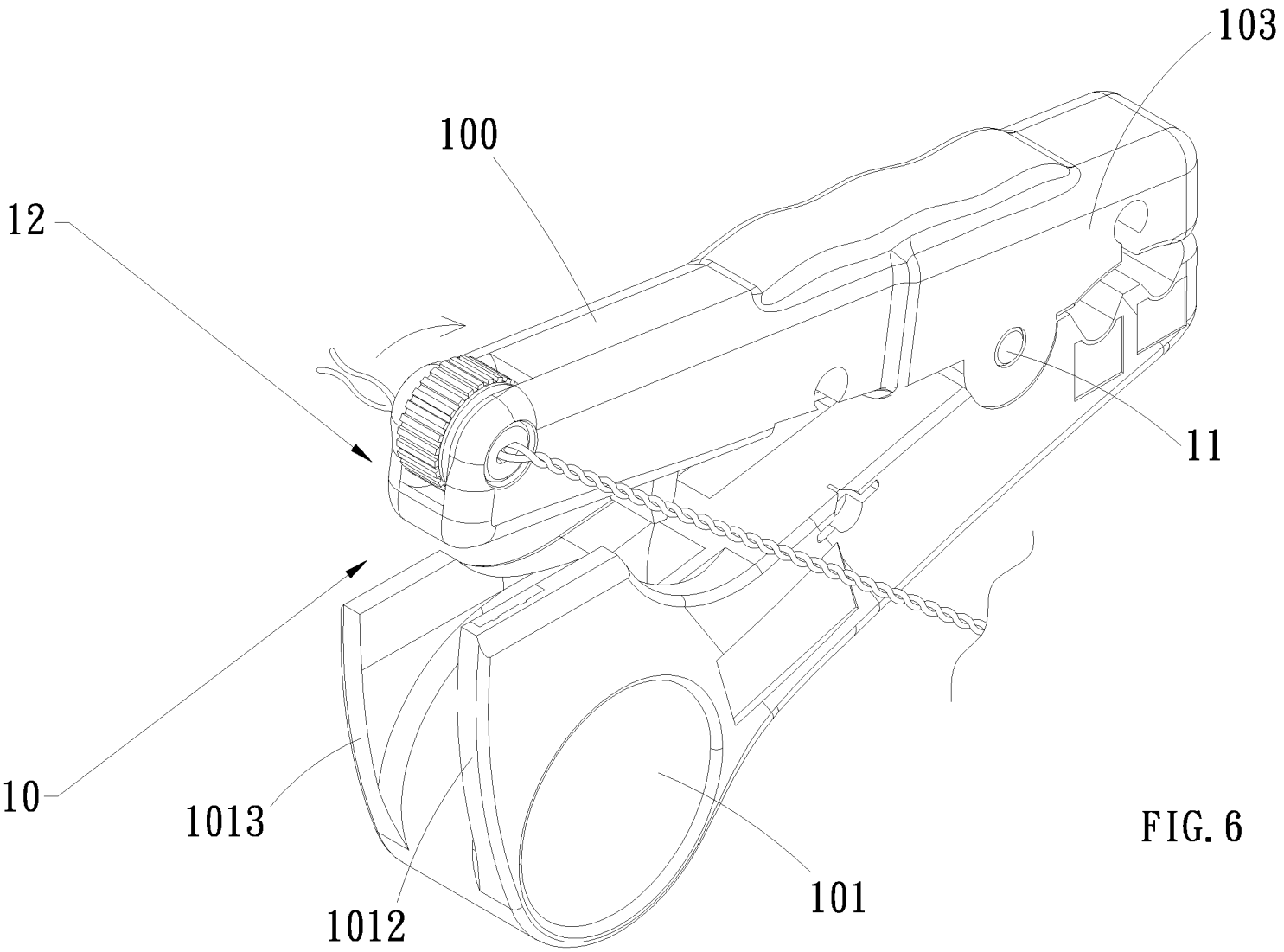
FIG. 6 is another perspective view showing the operation of the wire straightening tool according to the first embodiment of the present invention.
Figure 7:
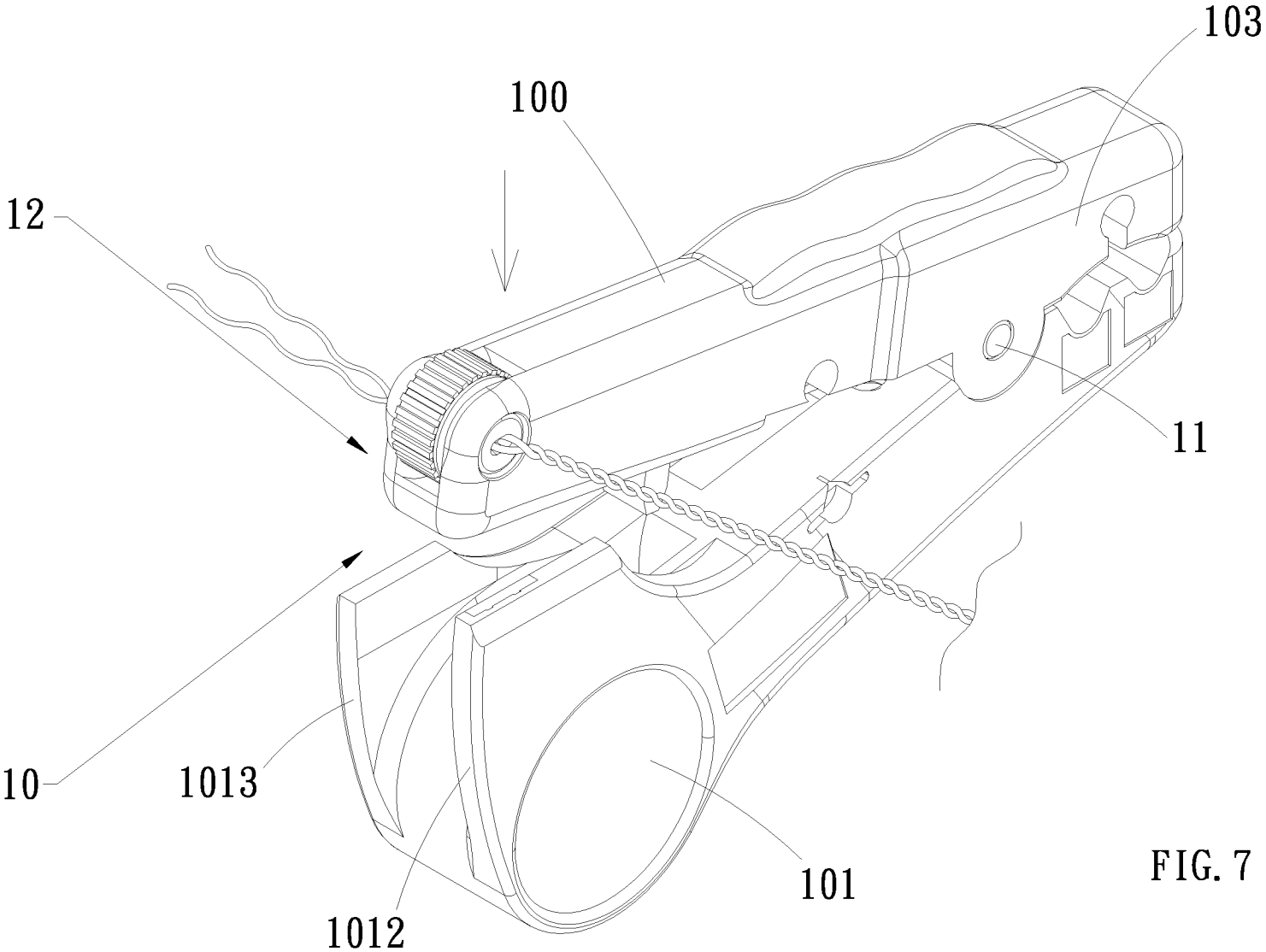
FIG. 7 is another perspective view showing the operation of the wire straightening tool according to the first embodiment of the present invention.
Figure 8:
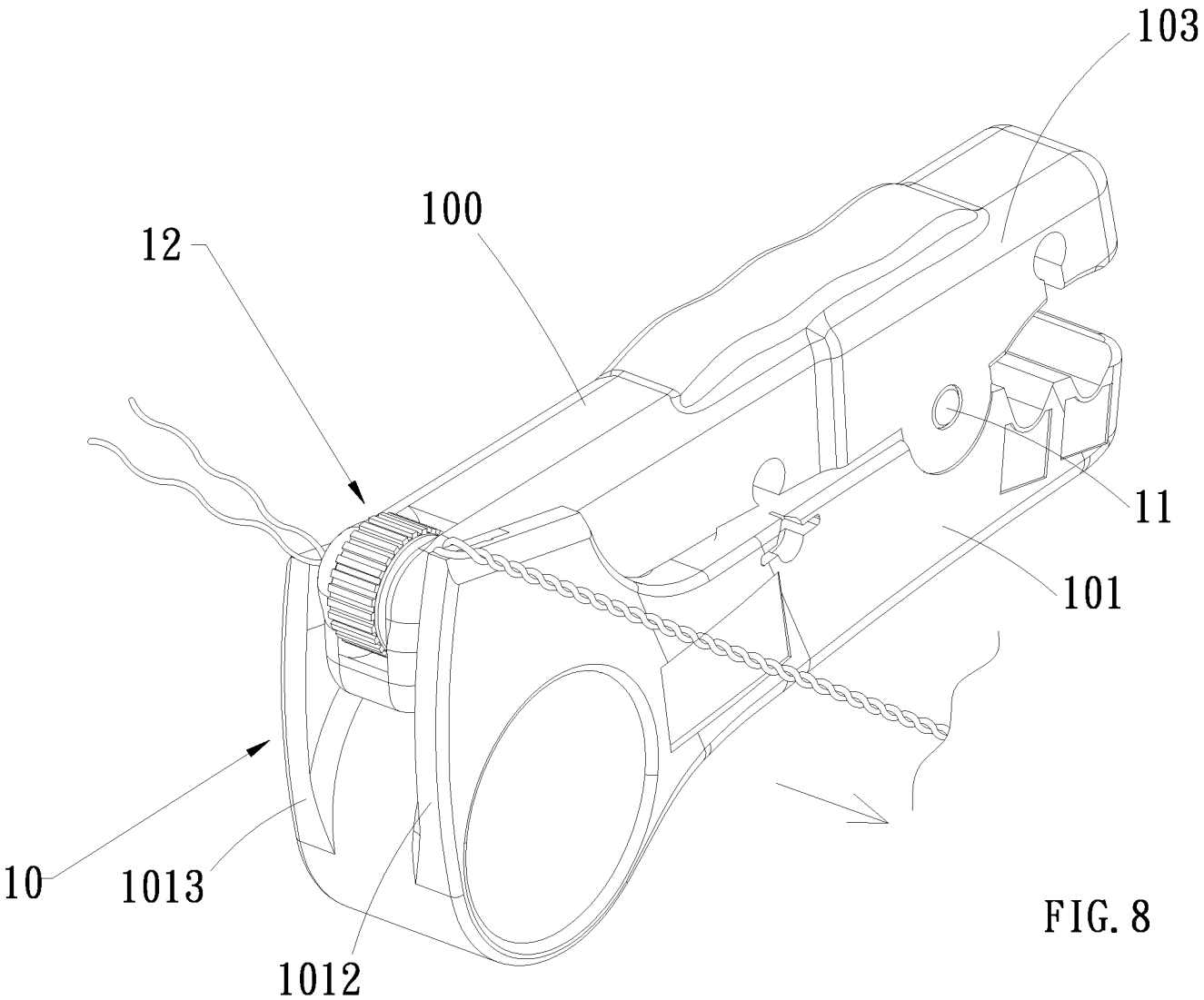
FIG. 8 is another perspective view showing the operation of the wire straightening tool according to the first embodiment of the present invention.
Figure 9:
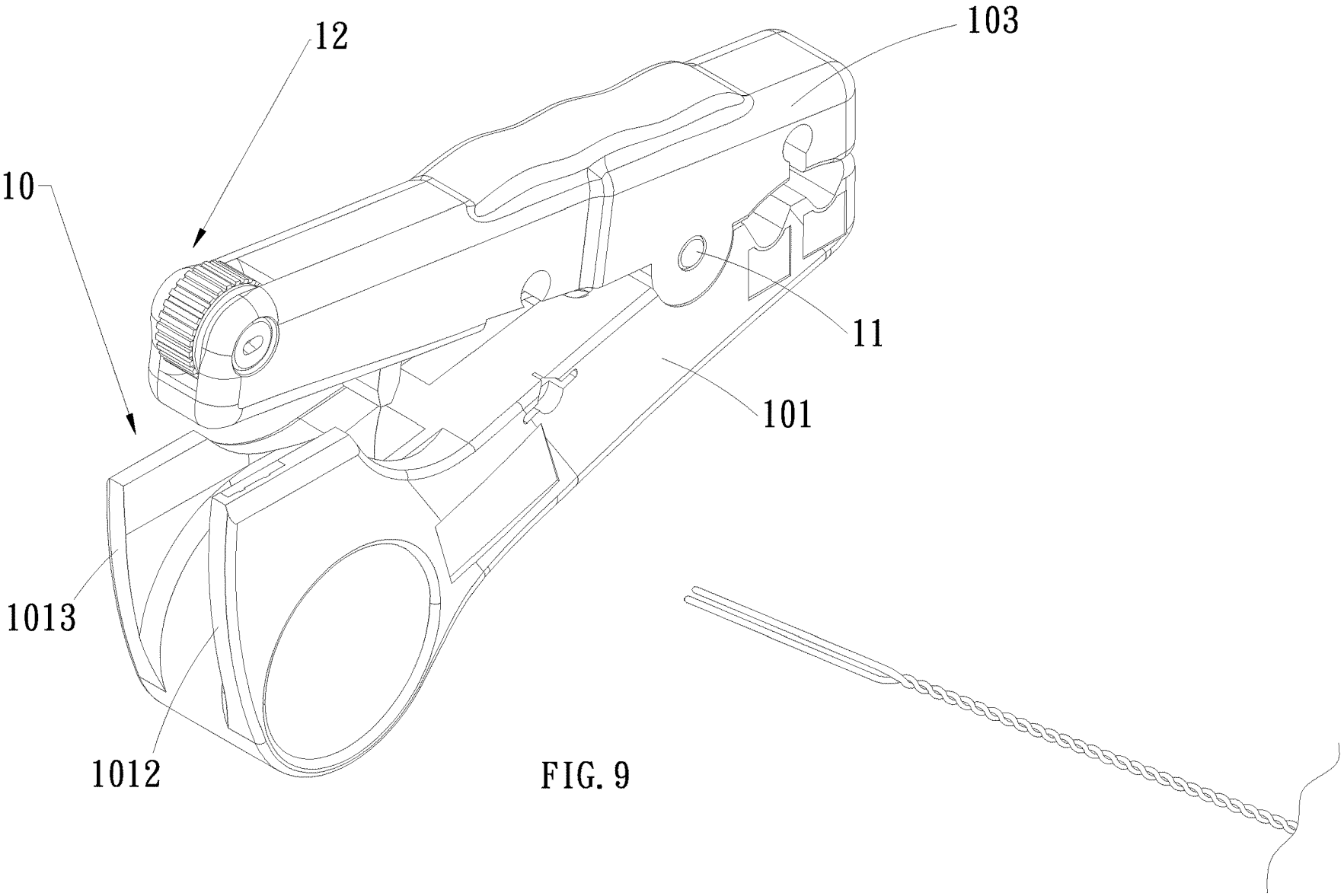
FIG. 9 is another perspective view showing the operation of the wire straightening tool according to the first embodiment of the present invention.

With reference to FIGS. 1-9, a wire straightening tool 1 according to a first embodiment of the present invention comprises: a press portion 10, an urging portion 11, and a rotation portion 12.

The press portion 10 includes a fixing orifice 100A defined on an end thereof and passing through the press portion 10.

The urging portion 11 is a resilient element mounted on a bottom of the press portion 10 away from the receiving orifice 100A and configured to urge the press portion 10 to return back to an original position after pressing the press portion 10.

The rotation portion 12 is accommodated in the receiving orifice 100A of the press portion 10, and the rotation portion 12 includes a rotatable knob 120 and a wire removal element 121, wherein the rotatable knob 120 has a coupling orifice 1201 passing through the rotatable knob 120, and the wire removal element 121 is received in the coupling orifice 1201, wherein the wire removal element 121 has multiple through orifices 1211 defined thereon.

The press portion 10 includes a first pressing element 100 and a second pressing element 101, wherein the first pressing element 100 has multiple first passing orifices 1001, the second pressing element 101 has multiple second passing orifices 1011, and a fixing element 102 passes through the multiple first passing orifices 1001 and the multiple second passing orifices 1011 to connect the first pressing element 100 with the second pressing element 101, thus forming a grip section 103. Furthermore, the second pressing element 101 has a straightening fringe 1012 formed on a first side thereof, a supply fringe 1013 formed on a second side of the second pressing element 101, a recess 1014 defined on a predetermined position of the straightening fringe 1012, and a pad 1015 received in the recess 1014 and made of flexible material.

When the first pressing element 100 presses the second pressing element 101, the supply fringe 1013 is not higher than the multiple through orifices 1211 of the wire removal element 121. The urging portion 11 is a spring. The rotation portion 12 is accommodated in the receiving orifice 100A of the press portion 10, the rotatable knob 120 of the rotation portion 12 has multiple protrusions 1202, and the coupling orifice 1201 of the rotatable knob 120 has a slope 1201A. The wire removal element 121 has a releasing segment 1212 formed on a first end thereof, and the wire removal element 121 has a supplying segment 1213 formed on a second end thereof, wherein a depth of the releasing segment 1212 is more than a depth of the supplying segment 1213, and a width of the releasing segment 1212 is less than a width of the supplying segment 1213.

In operation, the grip section 103 of the press portion 10 is grasped manually, and a front end of a twisted wire which is not twisted is accommodated in the wire removal element 121 of the rotation portion 12 so that the other part of the front end of the twisted wire is put into the multiple through orifices 1211 from the releasing segment 1212 of the wire removal element 121. Since the depth of the releasing segment 1212 is more than the depth of the supplying segment 1213, and the width of the releasing segment 1212 is less than the width of the supplying segment 1213, the twisted wire does not straighten, and the multiple protrusions 1202 of the rotatable knob 120 of the rotation portion 12 are rotated by a user's finger(s) so that the rotatable knob 120 rotates and actuates the wire removal element 121 to revolve, and the twisted wire is pushed manually or the wire straightening tool 1 is moved so that the twisted wire extends out of the supplying segment 1213 from the releasing segment 1212 via the multiple through orifices 1211, and the wire removal element 121 revolves to untwist the twisted wire.

Preferably, the rotatable knob 120 is not rotated based on an extending length of the twisted wire, and the first pressing element 100 of the press portion 10 presses the second pressing element 101 so that the twisted wire is pressed in the press portion 10, and the twisted wire is pulled out of the wire removal element 121 of the rotation portion 12 but not be stuck when passing through the supply fringe 1013 of the second pressing element 101 by using the multiple through orifices 1211 and the supplying segment 1213. Furthermore, the twisted wire is straightened by ways of the releasing segment 1212 of the second pressing element 101 and the first pressing element 100, and the pad 1015 is configured to protect the twisted wire when the twisted wire is pulled to avoid a damage of a core of the twisted wire. Thereafter, the first pressing element 100 of the press portion 10 is released so that the urging portion 11 urges the first pressing element 100 to move back to the original position, thus recovering the press portion 10.

In a second embodiment, the urging portion 11 of the wire straightening tool 1 is one-piece formed with any one of the press portion 10, the first pressing element 100 of the press portion 10, and the second pressing element 101. In addition, the coupling orifice 1201 of the rotatable knob 120 of the rotation portion 12 has a slope 1201A so that the rotatable knob 120 is connected with the wire removal element 121 securely, wherein the wire removal element 121 has a locating section 1214 defined on a predetermined position thereof, the locating section 1214 is less than the wire removal element 121, and the wire removal element 121 is glued so as to connect the rotatable knob 120 with the wire removal element 121.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A wire straightening tool comprising:

a press portion, an urging portion, and a rotation portion;

wherein the press portion includes a fixing orifice defined on an end thereof and passing through the press portion;

wherein the urging portion is an urging element mounted on a bottom of the press portion away from the receiving orifice and configured to urge the press portion to return back to an original position after pressing the press portion;

wherein the rotation portion is accommodated in the receiving orifice of the press portion, and the rotation portion includes a rotatable knob and a wire removal element, wherein the rotatable knob has a coupling orifice passing through the rotatable knob, and the wire removal element is received in the coupling orifice, wherein the wire removal element has multiple through orifices defined thereon;

wherein the wire removal element of the rotation portion has a locating section defined at a predetermined position of the wire removal element, a diameter of the locating section is less than a diameter of the wire removal element, and the locating section is glued so as to connect the rotatable knob with the wire removal element.

2. The wire straightening tool as claimed in claim 1, wherein the press portion includes a first pressing element and a second pressing element, wherein the first pressing element has a first passing orifices, the second pressing element has a second passing orifices, and a fixing element passes through the first passing orifices and the second passing orifices to connect the first pressing element with the second pressing element, thus forming a grip section.

3. The wire straightening tool as claimed in claim 2, wherein the second pressing element has a straightening fringe formed on a first side thereof, a supply fringe formed on a second side of the second pressing element, a recess defined at a predetermined position of the straightening fringe, and a pad received in the recess and made of flexible material; when the first pressing element presses the second pressing element, the supply fringe is not higher than the multiple through orifices of the wire removal element.

4. The wire straightening tool as claimed in claim 1, wherein the urging portion is a spring.

5. The wire straightening tool as claimed in claim 1, wherein the urging portion is one-piece formed with the press portion.

6. The wire straightening tool as claimed in claim 1, wherein the rotatable knob of the rotation portion has multiple protrusions, and the coupling orifice of the rotatable knob has a slope.

7. The wire straightening tool as claimed in claim 1, wherein the wire removal element has a releasing segment formed on a first end thereof, and the wire removal element has a supplying segment formed on a second end thereof, a depth of the releasing segment is more than a depth of the supplying segment, and a width of the releasing segment is less than a width of the supplying segment.

* * * * *